US006719194B2

(12) United States Patent
Richards

(10) Patent No.: US 6,719,194 B2
(45) Date of Patent: Apr. 13, 2004

(54) WASTE STORAGE DEVICE

(75) Inventor: David Charles Richards, Near Lymington (GB)

(73) Assignee: Melrose Products Limited, Guernesy (GB)

( * ) Notice: Subject to any disclaimer, the term of this patent is extended or adjusted under 35 U.S.C. 154(b) by 73 days.

(21) Appl. No.: 09/973,682

(22) Filed: Oct. 9, 2001

(65) Prior Publication Data

US 2002/0066261 A1 Jun. 6, 2002

Related U.S. Application Data

(63) Continuation of application No. PCT/GB00/01307, filed on Apr. 7, 2000.

(30) Foreign Application Priority Data

Apr. 9, 1999 (GB) ..... 9908206

(51) Int. Cl.[7] ..... B65D 91/00

(52) U.S. Cl. ..... 232/43.1; 232/43.3; 53/567; 53/576; 220/263; 220/908.1

(58) Field of Search ..... 232/43.1, 43.2, 232/43.3; 220/908.1, 263; 53/567, 576, 370, 390, 549

(56) References Cited

U.S. PATENT DOCUMENTS

| | | | | | |
|---|---|---|---|---|---|
| 3,595,507 | A | * | 7/1971 | Kurlander | 248/97 |
| 3,665,522 | A | | 5/1972 | Backlund et al. | |
| 3,908,336 | A | * | 9/1975 | Forslund | 53/576 |
| 4,081,105 | A | * | 3/1978 | Dagonnet et al. | 220/263 |
| 4,519,104 | A | | 5/1985 | Nilsson | |
| 4,869,049 | A | * | 9/1989 | Richards et al. | 53/459 |
| 5,125,526 | A | * | 6/1992 | Sumanis | 220/263 |
| 5,147,055 | A | * | 9/1992 | Samson et al. | 220/259.2 |
| 5,385,259 | A | * | 1/1995 | Bernstein et al. | 220/495.11 |
| 5,520,303 | A | * | 5/1996 | Bernstein et al. | 220/495.08 |
| 5,535,913 | A | * | 7/1996 | Asbach et al. | 220/495.08 |
| 5,590,512 | A | * | 1/1997 | Richards et al. | 53/567 |
| 5,655,680 | A | * | 8/1997 | Asbach et al. | 220/495.11 |
| 5,813,200 | A | * | 9/1998 | Jacoby et al. | 53/567 |
| 6,065,272 | A | * | 5/2000 | Lecomte | 53/576 |
| 6,128,890 | A | * | 10/2000 | Firth | 53/567 |
| 6,145,283 | A | * | 11/2000 | Noordenbos et al. | 53/554 |
| 6,170,240 | B1 | * | 1/2001 | Jacoby et al. | 53/567 |
| 6,370,847 | B1 | * | 4/2002 | Jensen et al. | 53/459 |
| 6,516,588 | B2 | * | 2/2003 | Jensen et al. | 53/459 |

FOREIGN PATENT DOCUMENTS

| | | | |
|---|---|---|---|
| EP | 0 903 305 A1 | | 3/1999 |
| EP | 0 699 584 B1 | * | 10/1999 |
| GB | 2 206 094 A | | 12/1988 |
| WO | WO 97/18992 | | 5/1997 |

* cited by examiner

*Primary Examiner*—William Miller
(74) *Attorney, Agent, or Firm*—Heslin Rothenberg Farley & Mesiti P.C.; Victor A. Cardona, Esq.

(57) ABSTRACT

A waste storage device includes an inlet aperture and a length of flexible tubing passing through the inlet aperture from a cassette. The flexible tubing is pinched by a pair of rollers which can have continuous surfaces or multiple paddles. The waste product is placed into the aperture and the rollers rotate drawing the waste product down into the device and pinching the storage bag above it. The operation can be manually or motor driven.

11 Claims, 8 Drawing Sheets

WASTE STORAGE DEVICE

CROSS REFERENCE TO RELATED APPLICATIONS

This application is a continuation of copending PCT application PCT/GB00/01307, filed Apr. 7, 2000, designating the United States and claiming priority from Great Britain application 9908206.7, filed Apr. 9, 1999. The priorities of both applications are claimed herein, and the entire disclosures of both are incorporated herein by reference.

The invention relates to a waste storage device and a method of operation of such a device.

One known waste storage device is disclosed in GB Patent No. 2206094 (incorporated herein by reference) and described here with reference to FIG. 1. The device is particularly useful for the storage for subsequent disposal of waste such as babies' nappies or other personal waste material. A plastics container 21 is formed with an internal flange 22 from which a cylinder 23 extends upwards. A pack consisting of a tubular core 1 inside a profusely circumferentially pleated length of flexible tubing 2 is located in the container 21 with the core 1 resting on the flange 22 and rotatable on the cylinder 23. To begin using the pack to form a series of packages of objects, which in this particular example will be considered to be babies' disposable nappies, the top of the flexible tubing 2 is pulled upwards and tied into a knot 24. This closed end can then form the bottom of a package to be formed along the length of part of the tubing. This is effected by pushing the closed end downwards inside the core 1 and cylinder 23 by the object to be packaged. As this is being done the flexible tubing 2 from the pleated length slides over the top edge 25 (FIG. 1) of the core 1 which is made sufficiently smooth to prevent the flexible tubing from being damaged. The core 1 may be approximately four inches (10.16 cm) diameter but, of course, the diameter of the flexible tubing 2 is substantially more Man this.

When the object has been thrust well into the concentric core 1 and cylinder 23, the package is closed by twisting the flexible tubing 2 above the object as at 30 (FIG. 1). This is done by turning the core 1 with remaining pleated tubing thereon about the core axis. A unit 31 is formed for this purpose in that it has a depending annular flange 50 formed with an outer surface that is a taper fit in a frusto-conical inner surface 51 at the top of the core 1. The package is prevented from turning about the axis of the core during this manual twisting action by springs 52 fixed to the container 21 and projecting radially inwards to engage the package. These springs are equidistantly spaced round the container 21. Shallow, grooves dividing upwardly extending ridges are formed on the frusto-conical inner surface 51 to stop slippage of the flexible tubing during the twisting operating.

By the aforesaid means, a series of connected closed packages 35 are formed and this can be continued until the pleated tubing 2 is exhausted. In the arrangement of FIG. 1 the packages collect in a bin portion 36 of the container closed at the bottom by a hinged base 53 normally held closed by a manually operable catch of suitable type. When it is desired to remove the packages from the bin portion 36 for transport to a waste disposal facility, the uppermost package is severed above its upper twisted closure 30 and the hinged base 53 opened for the removal of the packages through the end of the bin portion. Even if the twisted seals between the packages become loosened, the lid and the newly formed topmost twisted seal with prevent the escape of odours, vapours and gases to the ambient atmosphere.

However, it has been found that when the tubing 2 is made of high density polyethylene the twisted joints remain remarkably tight.

A development of this arrangement is disclosed in GB 2292725 (incorporated herein by reference) and described here with reference to FIG. 2. It will be seen that an outwardly flared funnel 12 having an inlet edge 15 is detachably connected to the top of the core 1 by a taper joint 16. The funnel improves the hygiene of the device yet further because the flexib drawn from the pack as an object is pushed down, over the inlet edge 15 of the funnel 12 to present a fresh and hygienic layer of tubing in the flared part of the funnel. The funnel 12 is twisted to obtain the twisted closure 30. An alternative spring arrangement 14 is shown in FIG. 2 and described fully in GB 2292725. GB 2206094 and GB2292725 both additionally disclose a cutting arrangement for severing the tubing when it is desired to remove the packages for disposal. A farther improved cutting arrangement is described in International Patent Application No. GB99/00243 which is incorporated by reference herein.

These known systems allow a simple and hygienic method of storing a large number of sanitary objects or packages such as diapers for disposal in an odour-free environment. However a certain amount of manual intervention is required for example opening lid, pushing the package through the Jaws and twisting the tubing above it. In particular in some commercial applications the user may wish to perform the operation with minimum intervention in particular to minimise contact with an apparatus containing waste from different origins.

The invention is set out in the claims. The invention provides a simple, low intervention, hygienic pedal operated system. The invention can be used without the need for twisting in one embodiment, a pair of rollers pinching a storage bag to prevent escape of odours, and the rollers may be symmetrically driven to rotate, improving the operation of the system. Alternatively a pair of paddle rollers allow the waste to be drawn down between successive pinch points. Provision of sensors allows the operation to be automated.

References herein to a storage bag or bag relate also to the flexible tubing discussed above having a knotted or otherwise closed end, or in its open configuration but acting as a bag.

Embodiments of the invention will now be described, by way of example, with reference to the drawings, of which:

Figure 9:
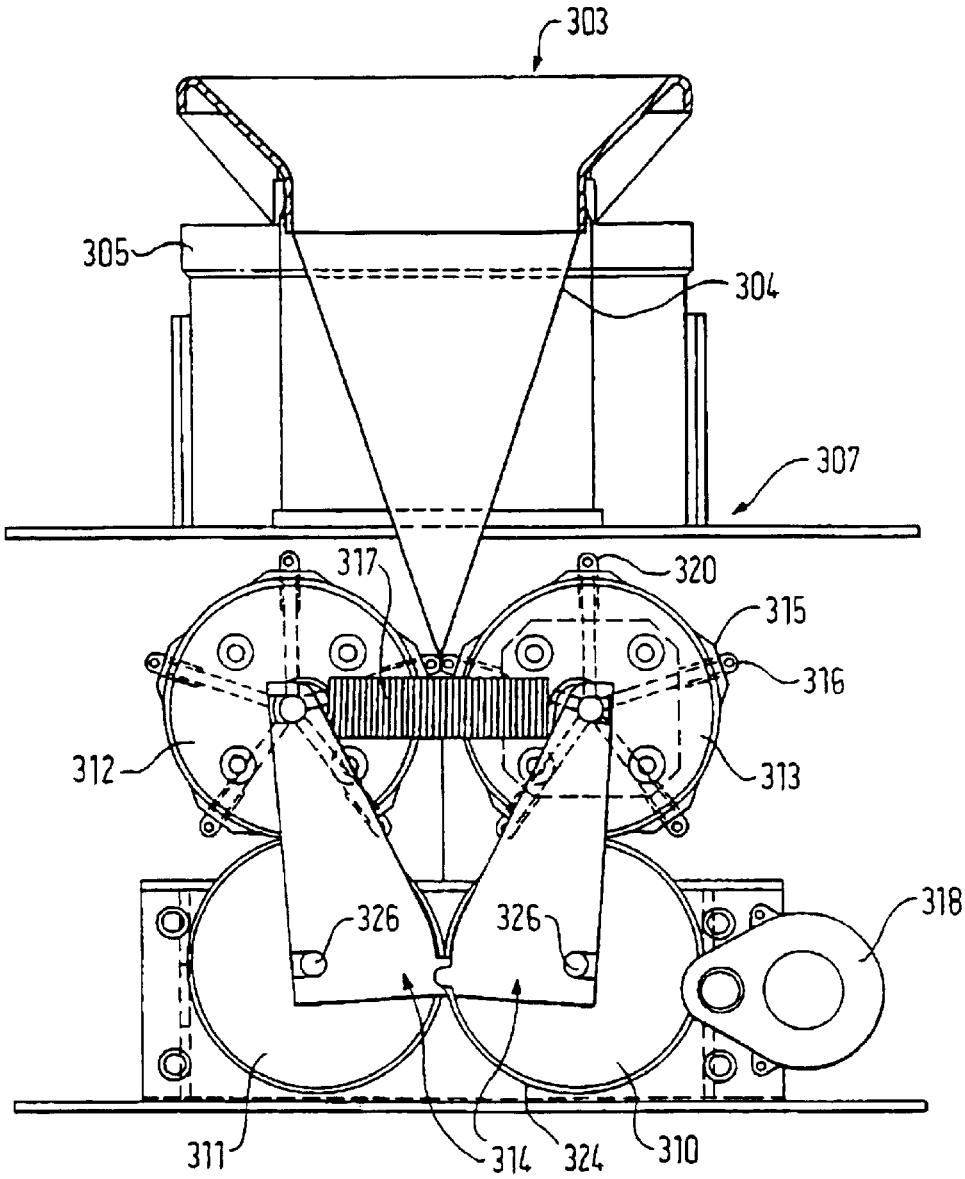
Figure 10:
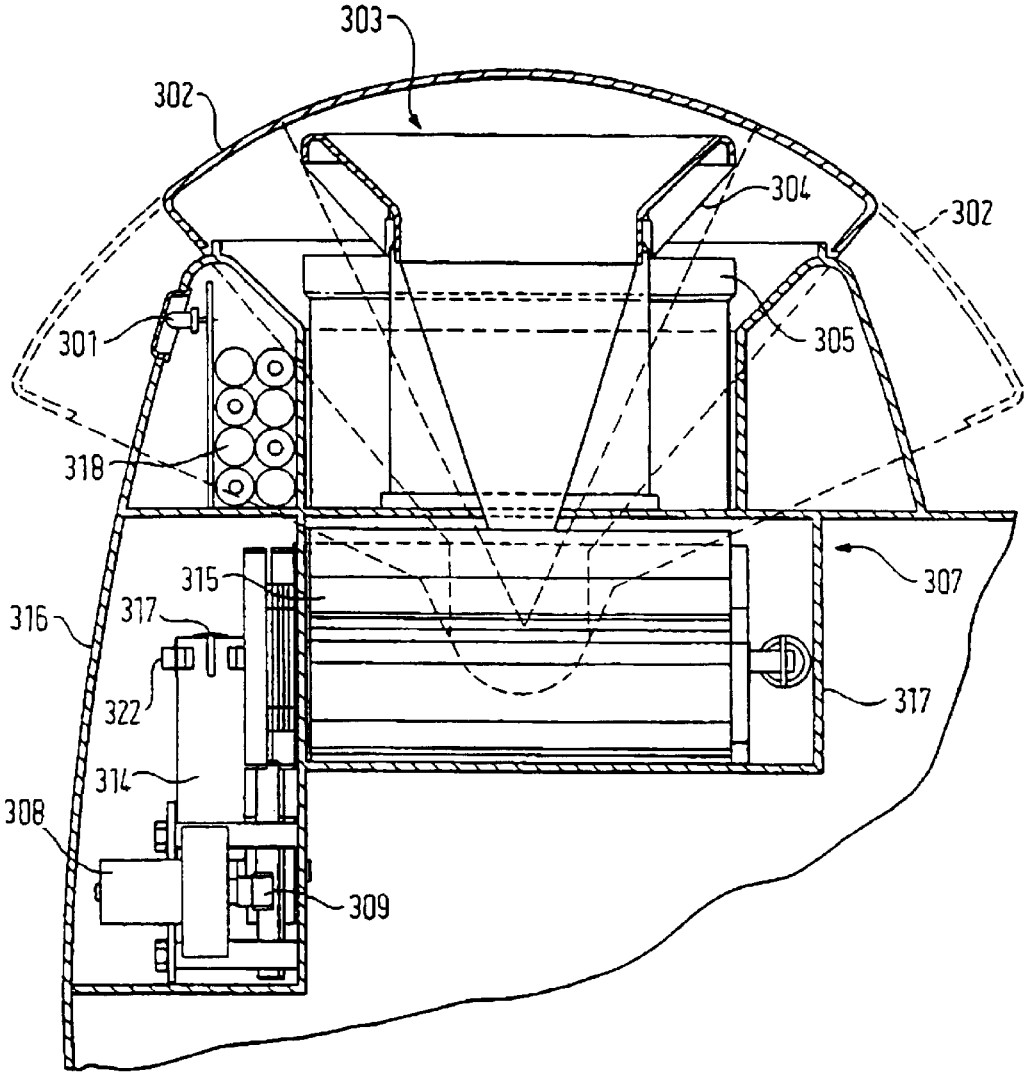

FIG. 9 in a cut-away view of components of a second embodiment of the present invention;

FIG. 10 shows a detail of the second embodiment of FIG. 9; and

Figure 11:
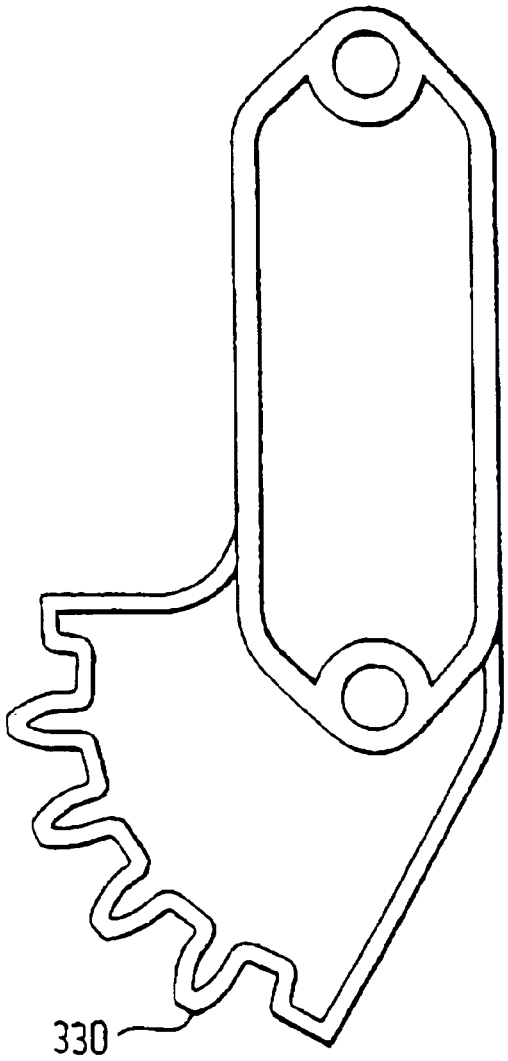

FIG. 11 shows a detail of the support arm according to the second embodiment of the invention.

Figure 3:
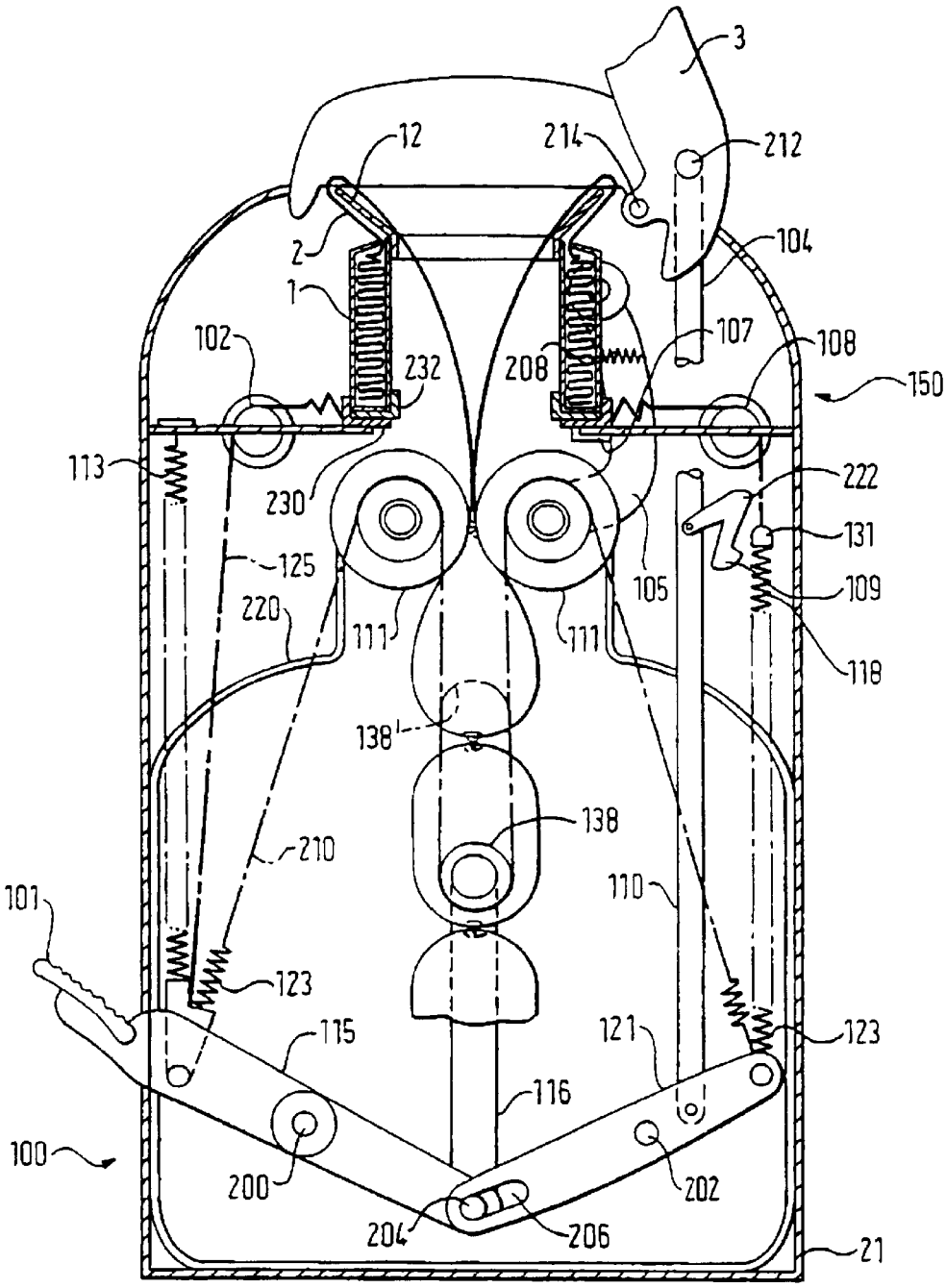
FIG. 3 is a partially sectional, schematic view showing a waste storage device according to the present invention.

The invention relates to a waste storage device of an improved type, in particular one which allows a simplified single-step operation. Referring to FIG. 3, in a preferred embodiment a container 21 includes a pedal assembly designated generally 100 which is connected via linkages described in more detail below to a pair of rollers which draw the package and flexible tubing down into the container and to means for rotating the core containing the flexible tubing to twist the tubing between the package and the lid of the container. The various linkages are spring loaded such that when the pedal is depressed the lid opens, the rollers are primed to draw the package downwards and the core containing the tubing is primed to rotate. Once the package has been inserted the pedal is released closing the lid, drawing the package downwards and finally rotating the core to close it above the packaging. As a result a fully automated system is achieved.

Referring to FIG. 3 in more detail, the pedal assembly 100 includes a pedal face 101 projecting from a suitable aperture in the container wall 21, towards the base of the container allowing easy foot operation. The pedal face 101 extends from an arm 115 centrally pivotally mounted on a first pivot 200. A second arm 121 is also centrally pivotally mounted on a pivot 202 and symmetrically positioned about the centre line of the container with relation to the first arm 115. In their relaxed position the arms 115, 121 slant downwardly towards the centre of the container 21 and are connected at their lower ends by a pin and slot arrangement 204, 206 allowing symmetrical pivotal movement of the arm 121 mirroring that to the arm 115 as the pedal face 101 is depressed providing unproved control and operation of the system as a whole. Also connected to the arms 115 and 121 at the connecting point is an upwardly extending further arm 116 which has at its upper end a freely rotating chain sprocket 138.

Below the core 1 of flexible tubing 2 are provided a pair of rollers 111, each biased into engagement with one another by arms 105 (of which only one is shown for clarity) loaded by springs 208. The tubing passes between the rollers 111 and is pinched between them to cut off odours from the storage space below the rollers. The rollers 111 are arranged for drawing flexible tubing and a package down into the body of the container. The rollers are driven by a chain 210 which is fixed at each end to an upper end (in the rest position) of the respective arms 115, 121, preferably via pivoting spring assemblies 123 allowing flexibility and give in the arrangement whilst maintaining tension at all times. The chain passes over a sprocket 180 on each roller 111 and down around the underside of the sprocket 138 on the arm 116 between and below the rollers. As a result the chain 210 adopts an M-configuration.

Figure 4:
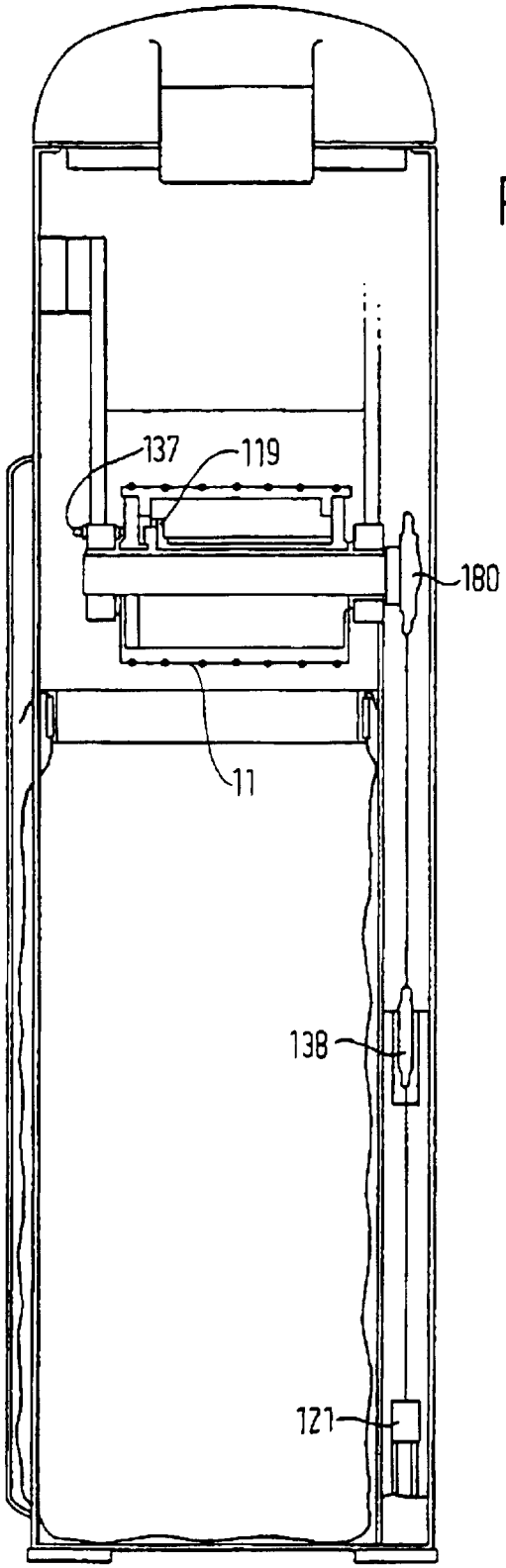
FIG. 4 is a side view of the arrangement shown in FIG. 3.

Referring to FIG. 4 it will be seen that rollers 111 interact with locking or clutch pins 37,119 allowing one-way operation by chain 210. The operation of the one-way drive assembly will be familiar to the skilled person, and any form of one-way drive, for example a suitable clutch is appropriate. In the version shown, as the chain passes in the first direction as the pedal is depressed, clutch pin 199 which has an angled face slips over the corresponding angle-toothed face of a clutch plate, whilst clutch pin 137 which has an angled face locks against the oppositely angle-toothed face of a further clutch plate. When the direction of rotation reverses, the clutch pin 119 locks against the oppositely-angled toothed face of the clutch plate, whilst clutch pin 137 conversely slips. Clutch pin 119 is keyed to the sprocket 180 via an axle through the roller 111 in the embodiment shown. It will be appreciated that references to a "clutch" embrace the specific angle-toothed arrangement set out above together with any other appropriate one-way drive.

Arm 115 is further biased into the rest upwardly slanted position by a tension spring 113 extending upwardly to an anchor point on the container 21. Arm 121 is attached via a rigid link 104 (partially shown) to a pivot point 212 offset from and generally above a pivot hinge 214 for the container lid 3. The rigid link 104 is also attached to the twisting arrangement designated generally 150 and discussed in more detail below.

This part of the operation of the invention will now be described in more detail. As the pedal face 101 is depressed the arm 115 pivots in an anti-clockwise direction about pivot 200. At the same time, by virtue of the engagement of pin 204 and slot 206 the symmetrical arm 121 pivots in a clockwise direction about pivot 202. The pin 204 and slot 206 move to an over centre position such that the arms 115 and 121 now slant in the opposite direction from the centre of the container 21 downwardly. The ends of the chain 210 are drawn downwardly, tension being maintained by the spring arrangements 123 on the respective ends of the arms 115, 121. At the same time arm 116 is raised such that the chain sprocket 138 is in the position shown generally as 138'. However because of the clutch pin arrangement 137, 119, the chain slips relative to the rollers 111 such that they do not rotate. At the same time, tension spring 113 is held under tension, urging the arm 115 back to its original position. Rigid link 104 is drawn downwardly by arm 121, pulling the container lid 3 into an open position by virtue of the offset of the pivot points 212, 214.

Accordingly at this stage the arrangement is primed for use, the pedal face 101 in its depressed position. A package such as a diaper or other waste product is inserted into the centre of the core 1 as explained in more detail above. The pedal face 101 is then released and the arm 115 is urged into its original position by tension spring 113. At the same time arm 121 is also urged to its original position by virtue of the interaction of pin 204 and slot 206, closing the lid 3 through the rigid links 104. The arm 116 is drawn downwardly bringing with it chain sprocket 138. Chain 210 now engages rollers 111 as clutch pins 137,119 now engage. As a result the rollers are driven such that their contacting faces each draw the package downwardly. The rollers are able to separate to accommodate the package by virtue of the spring loaded arms 105. In order to load a new core 1 with flexible tubing 2 it is simply necessary to knot the end of the tubing and push it down between the rollers 111 so that it is securely gripped.

Figure 1:
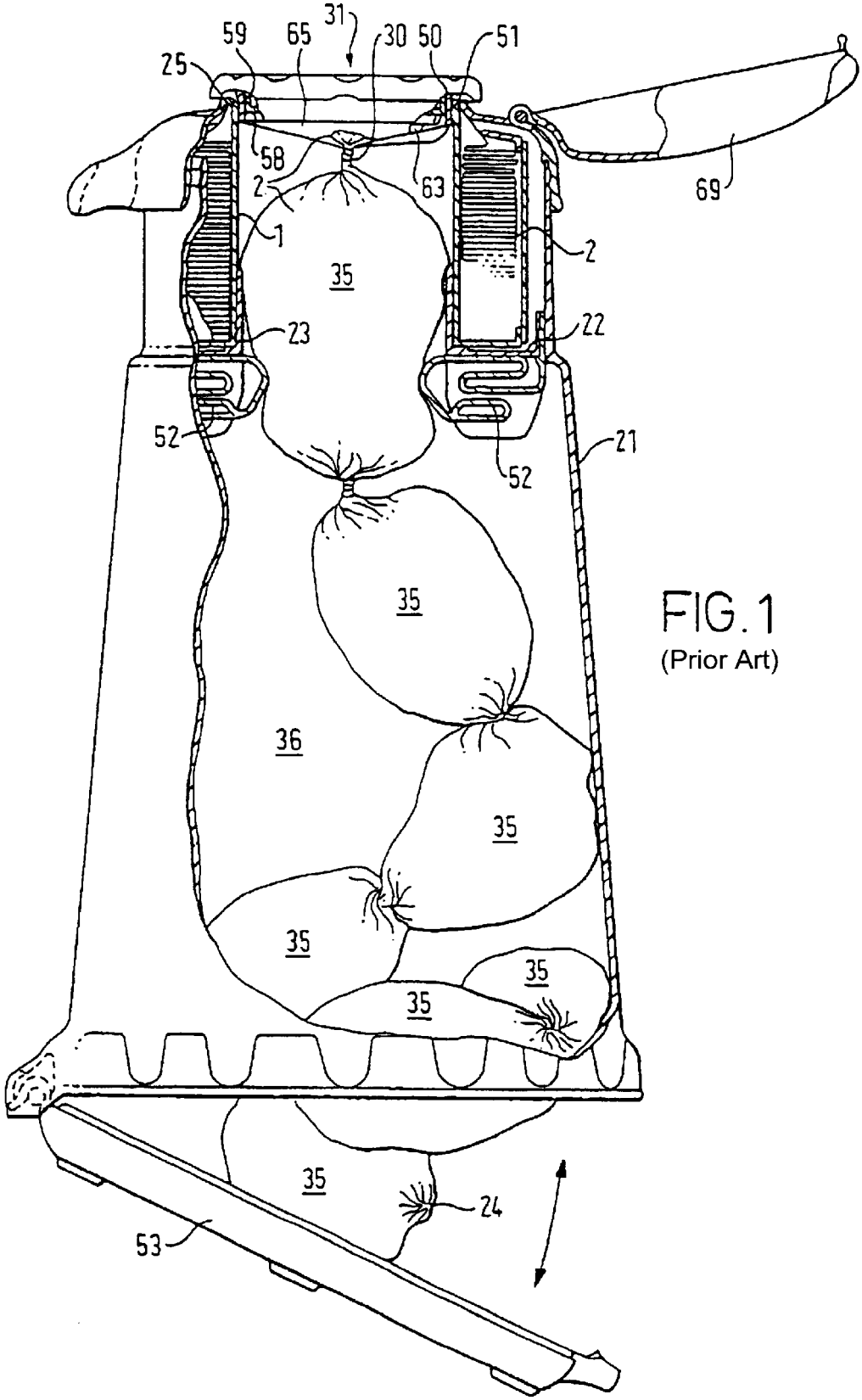
FIG. 1 (Prior Art)
FIG. 1 is a partially cut-away side view of a device of known type.
Figure 2:
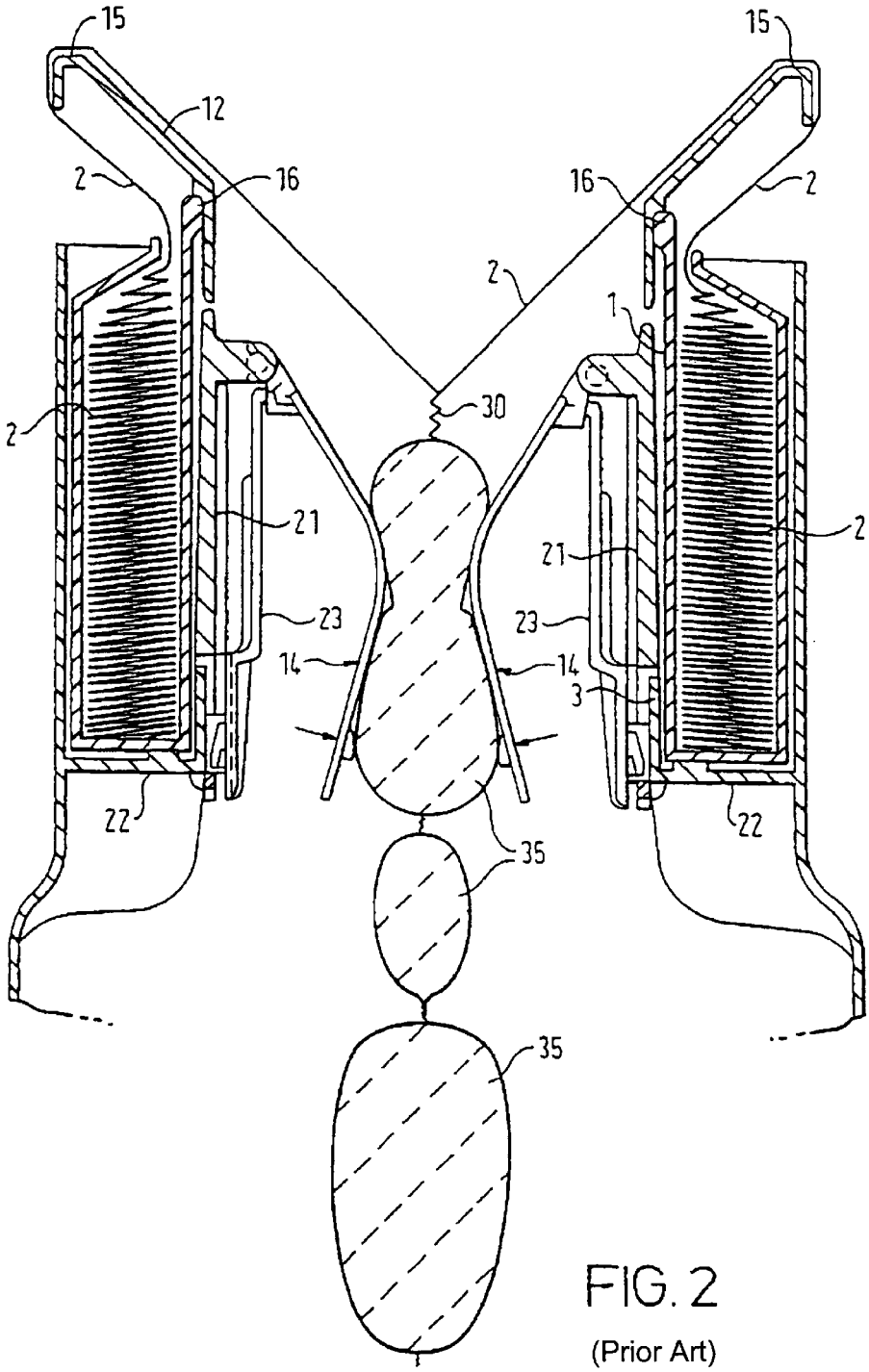
FIG. 2 (Prior Art)
FIG. 2 is a partial sectional side view of another device of known type.

As a result the user merely has to depress the pedal face 101 and insert the package into the open centre of the core 1. Depression of the pedal face 1 preloads the system such that mere release of the pedal face 101 allows the remainder of the operation to be completed without further user intervention. As can be seen the embodiment includes a funnel 12 as discussed in relation to FIG. 2. In addition there is provided in the preferred embodiment an outer bag 220 into which the flexible tubing containing the packages is received. As a result the hygiene of the system for the user is enhanced in particular by the funnel 12, and a double-layer system is provided to reduce the risk of osmosis by virtue of the outer bag 220. This arrangement is described in more detail in international application No. WO98/17536 which is incorporated herein by reference. In addition the cover has a continuously curved upper surface preventing users from resting items such as cigarette ends on it.

Figure 5:
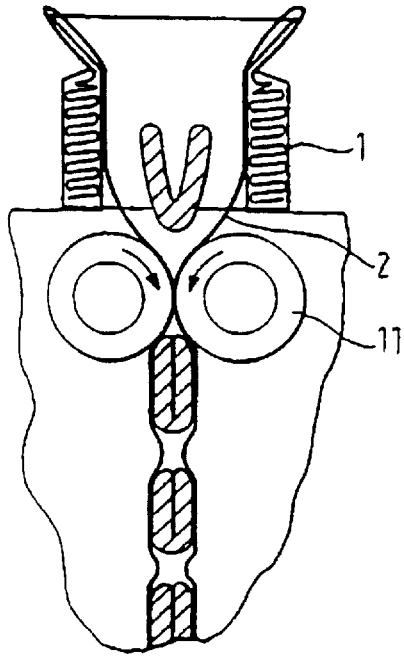
FIG. 5 shows the storage of packages in the waste storage device in a first configuration.

Referring now to FIG. 5, the packaging arrangement achieved by the invention described thus far is shown. In particular the rollers 111 pinch the flexible tubing above the package that has been most recently drawn through, recording risk of odour escape. In addition a tight seal and generally tight packaging as shown at 34 are achieved as air is squeezed out by the rollers 111 allowing additional compaction of waste in a given volume. In practice this system is simple to manufacture and operate and requires minimal user effort whilst maintaining the level of hygiene and ease of use of previous waste disposal systems.

Alternatively or in addition a linkage system can be incorporated as discussed above allowing a further step of twisting the flexible tubing above successive packages. Returning to FIG. 3 arm 121 is further attached to an upwardly extending rigid link 110 at a pivot point 220 arranged above and to the right of the main pivot 202 in a relaxed position. As a result when pedal face 101 is depressed and arm 121 rotates in a clockwise direction about pivot 202, rigid link 110 is drawn downwardly. Attached to the upper end of the link 110 is a catch assembly 109 which is generally V-shaped, with pivot point 222 at the apex of the V, a point of connection to the link 110 at one end and a catch at the other end. Movement of the link 110 rotates the catch 109 into and out of engagement with a stop 131 on a tension spring 118. The tension spring 118 is attached via stop 131 to a cable 125. The cable 125 passes around a pair of V-pulleys 102, 108 having axes parallel to one another and perpendicular to the axis of rotation of the core 1. The cable is attached at its other end to the upper end of arm 115 in its relaxed position.

Figure 6:
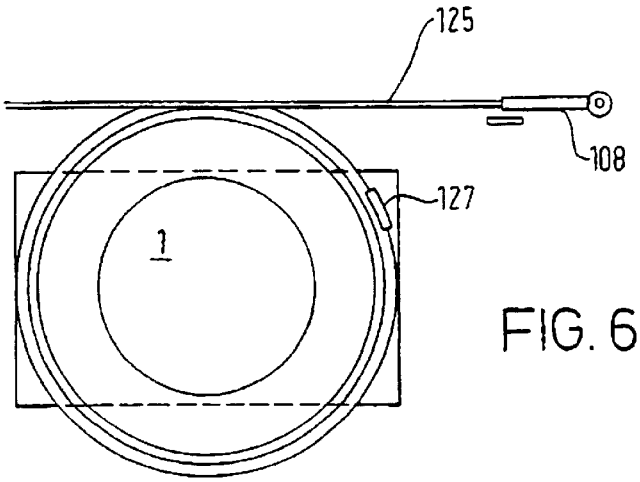
FIG. 6 shows a detail of a means of rotating the core of flexible tubing in a waste storage device.

FIG. 6 shows, between the V-pulleys 102, 108, the cable 25 passing around an outer, rotatable support 230 for the core 1 and anchored at 127 thereto. The outer support 230 has an annular horizontal face on which an inner support 232 for the core rests and a vertical outer face around which the cable passes. The inner support 232 is rotatable on the outer support 230 but rotatably fixed in relation to the core 1 which rests upon it Rotation of the inner and outer supports 230, 232 can be locked by a catch 107 allowing the outer support 230 to rotate independently of the inner support 232 in a first direction, but to lock rotation of both of them in the opposite direction. Operation of the catch 107 is again in accordance with the principles of a one-way clutch which will be well-known to the skilled person. In particular a pair of clutches having angled faces cooperating with saw-toothed clutch faces may be provided allowing simultaneous lock and slip in a first direction, and the converse in the reverse direction, as discussed in relation to clutch pins 119,137 discussed above. Preferably the angle of the faces is shallow allowing reasonable freedom in the drive slipping direction.

When the foot pedal is depressed the cable 12 is drawn downwardly around pulley 102, and rotates the outer support 230 in the first direction. In this direction the catch 107 is disengaged such that the inner support 232 does not rotate with the outer support 230. The cable passes around pulley 108 and draws the tension spring 118 into tension. The tension spring 118 is locked in that position by catch 109 which is rotated into engagement with the stop 131 as the rigid link 110 is drawn downwardly by the arm 121. In addition, as discussed in more detail above, the rollers 111 are preloaded, the lid 3 is lifted upwardly and so forth. When the pedal face 101 is released the arm 115 is drawn back upwardly by virtue of the tension sprig 113, rotating the rollers and drawing the packages down as discussed in more detail above. The arm 121 reverts to its original position pushing rigid link 110 upwardly and rotating the catch 109 out of engagement with stop 131. The catch 109 and stop 131 co-operate such that the stop is released only at the end of the stroke of the rigid link 110. As a result, once the arm 121 has reverted to its rest position, and the package has been drawn below rollers 111, spring 118 is released allowing it to contract. This draws the cable 125 rapidly downwardly around the pulley 108, rotating the outer support 230 in the opposite direction and hence, by virtue of engagement of the catch 107, the inner support 232 as well. As a result the core 1 is twisted relative to the rollers 111 creating a twist in the flexible tubing 2 above the package. When the outer support 230 stops rotating, there may be a small amount of additional rotation of the inner support 232 by virtue of its momentum because of the rapidity at which the spring 118 relaxes and the shallow angle on the clutch slip face in the drive direction, creating further twisting and a yet tighter seal.

Figure 7:
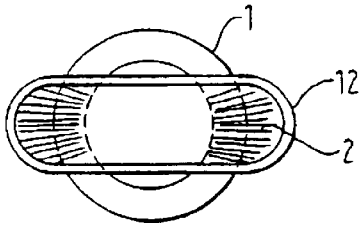
FIG. 7 shows an alternative inlet arrangement for the waste storage device.

FIG. 7 shows a slight variant on the arrangement of FIG. 5 in which a different shaped funnel is provided allowing certain waste items to be more easily inserted. In particular the funnel is of an elongate oval shape but any appropriate shape may be selected as long as its circumference is substantially the same as that of the circular funnel.

Figure 8:
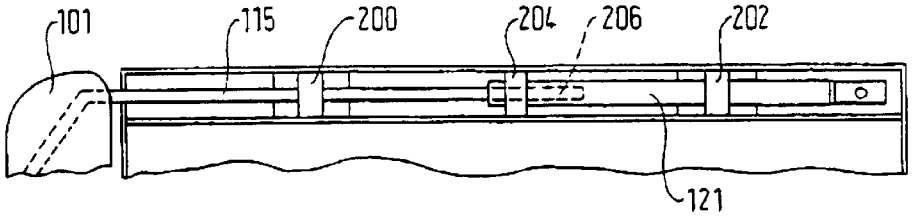
FIG. 8 shows a modular component for the system.

It will be appreciated that the pedal assembly 100 including the chain 210, and the rotating assembly 150 can be provided offset from the flexible tubing and outer bag 220, as can be seen in FIG. 4. As a result there is no interference between the assembly and the positioning and storage of the packages. In addition the assembly can be made in modular form as shown in FIG. 8 and retrofitted to existing arrangements in any sized container.

Referring now to FIG. 9, an alternative embodiment is shown in which the foot operated system is replaced by a motor driven system. As discussed previously, the waste inlet includes a funnel 303 over which a length of flexible tubing 304 passes stored in a cassette 305, the flexible tubing 304 is drawn down into a waste receptacle (not shown) below a pair of rollers 315 carrying paddles or fingers 316. In the embodiment shown the paddles include rounded rubber or otherwise flexible ends 320, and the rollers 315 are arranged to rotate in contrary directions synchronised such that, as the rollers rotate, the corresponding paddles from each roller come into engagement between the rollers. The rollers are mounted on support arms 314 and are biased together by a tension spring 317 linking their axes of rotation such that the blades are pulled into engagement but the rollers can nonetheless rotate.

A motor 318 which can be, for example, a 12 volt DC motor co-operates with a gear train to drive a gear 310 which drives a first roller 315 and a second gear 311. The second gear 311 drives a second roller 315 such that the two rollers rotate in contrary direction. The rollers 315 preferably include gears 312,313 on which the paddles are mounted.

Turning now to the rollers 315 once again, in the version shown five equiangular paddles are provided on each roller although it will be appreciated that any appropriate number of paddles can be adopted Each of the paddle blade tips is covered by a soft rubber extrusion 320 which ensures a high coefficient of friction between the paddle blade tip and the external face of the film to prevent slipping. As a result as the paddles rotate into engagement with one another and then move generally downwards, they pull the film at the same time, a constant pinching force being introduced by the biasing of pinch springs 317 (a further spring is provided at the rear, not shown).

Referring now to FIG. 10 further detail of the upper part of the waste disposal device is shown, where common reference numerals denote common parts. Mounted to the thin outer body 306 are pivoting dual-type lid halves 302 which pivot between a closed position (shown in solid lines) and an open position (shown in dotted lines). In the open position waste can be placed into funnel 303. The lid halves are powered in any appropriate manner to open upon detection of a waste product by infrared or other appropriate sensor 301 which is connected to appropriate control means (not shown). One paddle roller 315 is shown in side view from which it can be seen that the paddles are planar in nature and elongate such that their blade tips 316 extend the full length of the waste aperture width such that the entirety of the flexible tubing is pinched closed between them. The transmission between the motor and gear train 8 and the paddles can be seen more clearly from FIG. 10, in particular the motor shaft transmits the drive via pinion 309 to gear 310 (visible in FIG. 9). As can also be seen from FIG. 10, in the embodiment shown, the pinch spring 317 extends between the upper ends of the support arms through which the axes 322 of the rollers pass.

In operation the bin is opened by the user passing the hand in front of the infrared or other sensor 301 mounted behind a lens (not shown) in the main case of the bin or receptacle 306. When the beam is broken the main outer lid 302 is powered open to reveal the funnel 303 and film 304. Control means are provided to control the operation and in the preferred embodiment the outer lid remains open for approximately 4.5 seconds giving the user sufficient time to place the waste material into the funnel. Closure of the lid 302 allows the motor 308 to be powered for a period, for example, of 15 seconds, the period being determined such that an appropriate length of film is drawn through the funnel. On insertion the waste material sits close to the pinch point between two engaging paddles on the rollers 315. As the film is drawn down and new film pulled out to replace it from the cartridge 305, the waste is also drawn down into the waste receptacle (best seen in FIG. 10). Once the cycle has been completed the device is ready to be activated by the next user.

The gear train 310, 311, 312, 313 ensures that each paddle is driven by the motor as discussed above. To avoid the gears 312, 313 meshing their diameter is small enough that when the roller axles are closest together (the position where the paddle tips are furthest from an imaginary line joining the axles of the rollers) the gears still do not meet. The support arms 314 mesh with each other at point 324 such that the rollers 315 are both equally displaced as waste passes between them. In the embodiment shown the support arms 314 are meshed by providing a nose on one arm registering with a notch on the other.

To accommodate a greater range of movement, this simpler arrangement can be replaced by a gear arrangement as shown in FIG. 11. FIG. 11 shows the detail of a support arm including an improved meshing feature with the corresponding support arm. As will be seen the arm includes a toothed circular portion arranged to engage with a similarly toothed or notched portion on the other arm allowing a greater degree of movement in register with one another. Preferably the arm is an H section. In particular a plurality of teeth 330 can be seen.

The axles 326 of the lower gears 310,311 rotate in bearings on the receptacle main body or fixed relative to the receptacle main body. The support arms 314 pivot around the axles 326 at their lower ends. The rollers 315 are held in the desired position, but free to move together and apart symmetrically, by virtue of the spring connection between the upper ends of the support arms 314 and the mesh engagement with the gears 310,311.

Because paddles or vanes are provided, the waste product placed into the funnel does not have to pass through the pinch point between co-operating paddles 320. For example in the embodiment shown, the pinch point moves downward by approximately 60 mm and the next pair of blades accordingly pinch approximately 60 mm above the previous pinch point. Packages up to 70 mm thick can be accommodated especially if the support arms are meshed as discussed above.

At the end of the operation the flexible tubing 304 is once again pinched above the waste area such that users cannot see down into the waste area and odours do not escape from it.

It will be appreciated that the various possible arrangements described herein can be interchanged as appropriate both in embodiments described and the documents incorporated by reference. In addition either the simplified roller system or the simplified twisting system of FIGS. 3 to 8 can be used independently of the other as appropriate. As a result the arrangements shown in FIG. 3 and discussed above in which each package is separated by twists above and below it is achieved.

In addition the embodiments shown in FIGS. 8 to 11 can be driven in any appropriate manner such as the batteries shown at 318 or mains power. Alternative motor types can be used and indeed manual operation, for example peddle operation as in FIGS. 2 to 8 can be adopted. The rollers can carry any desired number of paddles with any appropriate spacing and the various materials used will be entirely evident to the skilled person.

What is claimed is:

1. A waste storage device comprising a waste inlet for insertion of a waste product, a storage space for the waste product and a throat therebetween, the waste storage device being arranged to receive a waste bag at the inlet, said waste bag extending into the storage space through said throat a gripper means provided at the throat operable to draw the waste product and bag through the throat and close the bag at the throat, said gripper means comprising co-operating rollers arranged to draw the waste product and bag through the throat by rotation and close the bag at the throat by pinching action, wherein the co-operating rollers are rotated by a leverage-operated drive, said leverage-operated drive biased to the rest position and arranged to rotate the rollers on its return to the rest position.

2. A waste storage device as claimed in claim 1 including a throat cover moveable between an open position and a closed position and means for operating the gripper means subsequent to the throat cover being moved to a closed position.

3. A waste storage device as claimed in claim 1 in which the leverage-operated drive is a pedal.

4. A waste storage device as claimed in claim 1 in which the leverage-operated device comprises a pair of arms arranged to pivot about respective centre points in mirror symmetry and having transmission means attached at respective symmetrical ends in co-operation with respective rollers.

5. A waste storage device as claimed in claim 4 in which the transmission means comprises a chain passing around the respective rollers and an intermediate sprocket associated with the pair of arms.

6. A waste storage device as claimed in claim 1 further including a linkage between the leverage-operated drive and a hingeable cover over the waste inlet arranged to open the hingeable cover on operation of the leverage-operated drive.

7. A waste storage device as claimed in claim 6 in which the leverage-operated drive is connected via a rigid link to a pivot point on the cover offset from the hinge of the cover.

8. A waste storage device as claimed in claim 1 in which a rotatable support for the waste bag arranged to fix the waste bag rotatably relative thereto is rotatable in the waste inlet relative to the gripper means and drive means are further provided operable to rotate the waste bag relative to the gripper means.

9. A waste storage device comprising a waste inlet for insertion of a waste product, a storage space for the waste product and a throat therebetween, the waste storage device being arranged to receive a waste bag at the waste inlet, said waste bag extending into the storage space through the throat, the waste storage device including a rotatable support provided in the waste inlet arranged to fix the waste bag rotatably relative thereto, and rotating means operable for rotating the support relative to the throat, said rotating means being rotated by a leverage-operated drive, the leverage-operated drive being a pedal, and wherein the leverage-operated drive is biased to a rest position and includes means for loading the support for rotation, and releasing the support to rotate once the drive returns to the rest position.

10. A waste storage device as claimed in claim 9 in which the support includes inner and outer portions, rotatably uncoupled as the support is loaded and rotatably locked as the support is released.

11. A method of disposing of waste in a waste storage device, the waste storage device including a throat, flexible tubing provided in the throat, gripper means, gripper drive means and a moveable throat cover in which the moveable cover is opened, waste is placed in the throat, the moveable cover is closed and the drive means operates the gripper means to draw the waste and flexible tubing through the throat and close the flexible tubing at the throat, the gripper means comprising co-operating rollers arranged to draw the waste product and flexible tubing through the throat by rotation and close the flexible tubing at the throat by a pinching action, the co-operating rollers being rotated by a leverage-operated drive, and wherein the leverage-operated drive is biased to a rest position and arranged to rotate the rollers on its return to the rest position.

* * * * *

UNITED STATES PATENT AND TRADEMARK OFFICE

CERTIFICATE OF CORRECTION

PATENT NO. : 6,719,194 B2
DATED : April 13, 2004
INVENTOR(S) : Richards

It is certified that error appears in the above-identified patent and that said Letters Patent is hereby corrected as shown below:

Column 8,
Line 35, insert a -- , -- after the word "throat"

Signed and Sealed this

Twenty-ninth Day of June, 2004

JON W. DUDAS
*Acting Director of the United States Patent and Trademark Office*